US010821351B2

(12) United States Patent
Khurana

(10) Patent No.: US 10,821,351 B2
(45) Date of Patent: Nov. 3, 2020

(54) GAME BOARD APPARATUS AND METHOD OF PLACEMENT OF TOKENS

(71) Applicant: Ashutosh Khurana, Delhi (IN)

(72) Inventor: Ashutosh Khurana, Delhi (IN)

( * ) Notice: Subject to any disclaimer, the term of this patent is extended or adjusted under 35 U.S.C. 154(b) by 0 days.

(21) Appl. No.: 16/446,657

(22) Filed: Jun. 20, 2019

(65) Prior Publication Data

US 2019/0299087 A1 Oct. 3, 2019

Related U.S. Application Data

(62) Division of application No. PCT/IN2018/050240, filed on Apr. 21, 2018.

(30) Foreign Application Priority Data

Apr. 21, 2017 (IN) ..... 201711014259

(51) Int. Cl.
*A63F 3/00* (2006.01)
*A63F 3/02* (2006.01)

(52) U.S. Cl.
CPC ..... *A63F 3/00697* (2013.01); *A63F 3/00* (2013.01); *A63F 3/00574* (2013.01); (Continued)

(58) Field of Classification Search
USPC ..... 273/276
See application file for complete search history.

(56) References Cited

U.S. PATENT DOCUMENTS 3,458,198 A * 7/1969 Scaduto ..... A63F 3/00006 273/441
4,448,422 A * 5/1984 Rose ..... A63F 3/0415 273/271

(Continued)

FOREIGN PATENT DOCUMENTS

WO WO 2018/193479 10/2018

OTHER PUBLICATIONS

International Search Report and the Written Opinion Dated Dec. 14, 2018 From the International Searching Authority Re. Application No. PCT/IN2018/050240. (11 Pages).

*Primary Examiner* — John E Simms, Jr.
*Assistant Examiner* — Dolores R Collins

(57) ABSTRACT

A game board apparatus (100) comprising at least two tokens (130) with a hollow open end (132) and a closed surface (134) including a cavity (136) a projection (138) extending from the closed surface (134); and a board (110) with a plurality of recesses (112) structured on the board (110) to receive the tokens (130), the recess (112) includes a first surface (114), a second surface (116) enclosed by the first surface (114), and a hole (118) at the center of the second surface (116), wherein the hole (118) receives the projection (138) and the second surface (116) receives the hollow open end (132) of the token (130) thereby avoiding displacement of the token (130) from the surface of the board and wherein the cavity (136) in the closed surface of the token receives the projection (138) of the token (130) thereby allowing stacking of the tokens (130). While playing a token (130) is placed over another token (130) forming a stack (144), wherein stacking is done by selecting the shortest path such that the number of steps taken for forming a stack (144) is same as the number of tokens (130) in the stack. FIG. 1 is the representative figure.

10 Claims, 3 Drawing Sheets

(52) U.S. Cl.
CPC ..... *A63F 3/00643* (2013.01); *A63F 3/02* (2013.01); *A63F 2003/00586* (2013.01); *A63F 2003/00608* (2013.01); *A63F 2003/00728* (2013.01); *A63F 2003/00801* (2013.01); *A63F 2003/00829* (2013.01); *A63F 2003/00867* (2013.01)

(56) References Cited

U.S. PATENT DOCUMENTS 4,497,491 A 2/1985 Holman
4,552,363 A * 11/1985 Rehkemper ..... A63F 9/12 273/241
4,560,170 A * 12/1985 Enyi ..... A63F 3/00075 273/248
4,801,147 A * 1/1989 Miller ..... A63F 3/00 273/236
5,249,807 A 10/1993 Peterson
5,332,229 A 7/1994 Fielder et al.
5,752,701 A 5/1998 Kao
5,954,340 A * 9/1999 Tedesco ..... A63F 9/26 273/449
6,325,374 B1 * 12/2001 Burger ..... A63F 3/00 273/236
8,460,103 B2 * 6/2013 Mattice ..... A63F 3/00157 463/16
8,810,590 B2 * 8/2014 Oat ..... G06T 13/20 345/530
9,962,603 B2 * 5/2018 Mikaelian ..... A63F 13/92
10,127,775 B2 * 11/2018 Clarebrough ..... G07F 17/34
2004/0007817 A1 * 1/2004 Orbanes ..... A63F 1/10 273/293
2005/0167917 A1 8/2005 MacIver et al.
2005/0274853 A1 * 12/2005 Ung ..... G07D 9/002 248/146
2010/0207328 A1 * 8/2010 Heumann ..... A63F 9/0669 273/292
2011/0111817 A1 * 5/2011 McLaughlin ..... A63F 3/00176 463/9
2013/0147115 A1 * 6/2013 Reid ..... A63F 3/02 273/242
2015/0028543 A1 * 1/2015 Reid ..... A63F 3/02 273/260
2017/0157500 A1 * 6/2017 Castro ..... A63F 3/00075

* cited by examiner

GAME BOARD APPARATUS AND METHOD OF PLACEMENT OF TOKENS

RELATED APPLICATIONS

This application is a division of PCT Patent Application No. PCT/IN2018/050240 having International filing date of Apr. 21, 2018, which claims the benefit of priority of Indian Patent Application No. 201711014259 filed on Apr. 21, 2017. The contents of the above applications are all incorporated by reference as if fully set forth herein in their entirety.

FIELD AND BACKGROUND OF THE INVENTION

Present invention relates a board game apparatus and a method of placement of tokens on the board and more particularly relates to the board game apparatus and a method that comprises of a board with recess of specific shape and tokens that are to be placed in the recess of the board in a specific pattern and then stacked to play the game.

Board games are used since many years for playing different games with tokens that are placed or positioned on the board. Board games that permit staking of the tokens have also been disclosed in the art. However, many a times certain movement of the board/tokens by the player results in unintentional displacement of other tokens or falling of the stack that may disrupt the game. Many a times, due to unintentional movement of hand or fingers of the player results in movement of board that further results in displacement of tokens on the board, which may create confusion with respect to placement of tokens on the board and thereby delaying the game.

Also, in our daily life, we are required to sequence various steps to take a conscious action for right/better results or desired/intended outcome. Sometimes we know from where to start this sequencing and sometimes we have to discover based on information given in the environment. Similarly, sometimes we know where we want to reach i.e. the end point and sometimes we have to discover what should be the end point or what possibly could be the end point again based on the information presented in the environment.

From where to start, why to start from there, what next to be done, how to reach to the next step and subsequent steps, where to end, is a function of mentally able to plan forward and/or backward various steps and/or options presented in the environment. Most of the times, we take an action without checking alternate or multiple start-points or what will happen/to be done next and thus the decision to take what action, when, why, where & how is largely influenced by the way in which information/steps/options are presented.

The problem to be solved is to provide a board game apparatus with a board and tokens shaped such that the token can be placed on the board such that the displacement of the token can be avoided, which can be due to the lifting or tilting of the board by user, and the problem is solved by the board game apparatus as in present invention that includes a token with a closed surface including a cavity and a projection that extends from the closed surface. This projection is received by a hole formed in recess formed on a game board. A further provision is provided in the token in the form of a hollow surface which is received by a convex surface formed in the recess on the board. This feature provides additional protection from displacement of the token.

The further problem to be solved is to bridge the gap of thinking existing in most of the members in the society. This gap is existing in adults, and as adults become the source of learning for children, it unknowingly is getting transferred to the next generation. This learning system, through its progressive structure of method of thinking requiring in solving various situations will enable the adults and children both (as active game players) to identify what is their deep rooted current process of thinking and what they need to change to achieve success in the given game/puzzle/thinking situation. The players can then relate the newly acquired learning, with an access to both the sets of thinking processes i.e. how they used to think in the past and how they should be thinking in their real-life situations to identify where they are using the old (not correct) process or pattern of thinking and thus in turn shall develop a conscious recognition of how they should be thinking in such situations.

The game situations/puzzles have been organised in a progressive structure of thinking processes or methods of thinking required as per the changing game/puzzle situations. This has been done to create this game as a progressive learning tool where the players can bridge the gaps from the basics and go to further complex processes as per self-learning and real-life application pace.

As playing of this game largely requires application of executive function, this game and its intended outcome to become a learning tool, while having the fun and engagement of a game, shall be relevant for a very long time. Even if the player plays the same situations again after 6 months, they will appear new as the player shall be again required to apply different skills under executive function to solve the game/puzzle situation, as long-term memory shall not be of much help in providing the answers achieved during the earlier sessions of game playing.

Thus, after a certain period of time, a player can play the situations, where they consciously worked upon to change the process of thinking because of incorrect results/outcome achieved in the game/puzzle situations earlier, to test whether the new conscious thinking process they acquired during earlier sessions is still a part of their subconscious thinking If not, this will bring a further insight that they need to practice application of missing processes of thinking better. If yes, they can now move on to the next level of complexity in the same game.

SUMMARY OF THE INVENTION

A game board apparatus comprising: at least two tokens with a hollow open end and a closed surface including a cavity; a projection extending from the closed surface; and a board with a plurality of recesses structured on the board to receive the tokens, the recess includes a first surface, a second surface enclosed by the first surface, and a hole at the center of the second surface, wherein the hole receives the projection and the second surface receives the hollow open end of the token thereby avoiding displacement of the token from the surface of the board and wherein the cavity in the closed surface of the token receives the projection of the token thereby allowing stacking of the tokens.

In an embodiment of the invention, the cavity in the closed surface of the token is cylindrical shaped.

In an embodiment of the invention, the first surface of the recess is protruding and the second surface of the recess is convex shaped.

In an embodiment of the invention, closed surface of the token has a structure analogous to the structure of the recess formed on the board to receive the token for stacking.

In an embodiment of the invention, the token includes at least one variable selected from a shape and a color.

In an embodiment of the invention, the token has a shape selected from an icing, a muffin and a plate.

A game board apparatus comprising: at least two tokens with a hollow open end and a closed surface including a cavity; a projection extending from the closed surface; a board with a plurality of recesses structured on the board in to receive the token, the recess includes a first surface, a second surface enclosed by the first surface, and a hole at the center of the second surface; and at least one card each consisting of different patterns of tokens indicating a start mode for the game; wherein the hole receives the projection and the second surface receives the hollow open end of the token thereby arranging the tokens in the start mode based on the pattern and avoiding displacement of the token from the surface of the board and wherein the cavity formed on the closed surface of the token receives the projection of the token thereby allowing stacking of the tokens.

In an embodiment of the invention, the cavity in the closed surface of the token is cylindrical shaped.

In an embodiment of the invention, the first surface of the recess is protruding and the second surface of the recess is convex shaped.

In an embodiment of the invention, the token includes at least one variable selected from a shape and a color.

In an embodiment of the invention, the shape includes three different shapes selected from an icing, a muffin and a plate.

In an embodiment of the invention, the pattern on the card has a starting point indicated by any one of an icing shaped token and a muffin shaped token, an ending point indicated by any one of a plate shaped token and a muffin shaped token.

A method of placement of token on the board comprising the steps of: arranging at least two tokens in a pattern provided in a card on the board indicating a start mode for the game; placing a token over another token forming a stack, wherein stacking is done by selecting the shortest path such that the number of steps taken for forming a stack is same as the number of tokens in the stack.

In an embodiment of the invention, while playing the game, a token is placed over another token only.

In an embodiment of the invention, in the method the player progresses to a next level of complexity based on the pattern on the subsequent card once a stack is arranged at one single point.

In an embodiment of the invention, in the method of placement of token on the board, a starting point for stacking is indicated by any one of an icing shaped token and a muffin shaped token, an ending point indicated by any one of a plate shaped token and a muffin shaped token.

In an embodiment of the invention, in the method for stacking the tokens move in any one of the vertical, horizontal, diagonal direction and their combination.

In an embodiment of the invention, there is at least one player. In an embodiment of the invention, in the method the player concluding the arranging of stack collects the tokens in the stack.

In an embodiment of the invention, the player having the maximum number of tokens in his stack is a winner.

In an embodiment of the invention, the method can be digital.

For a better understanding of the invention and to show how the same may be performed, the invention will now be described, with reference to the accompanying drawings.

Figure 1:
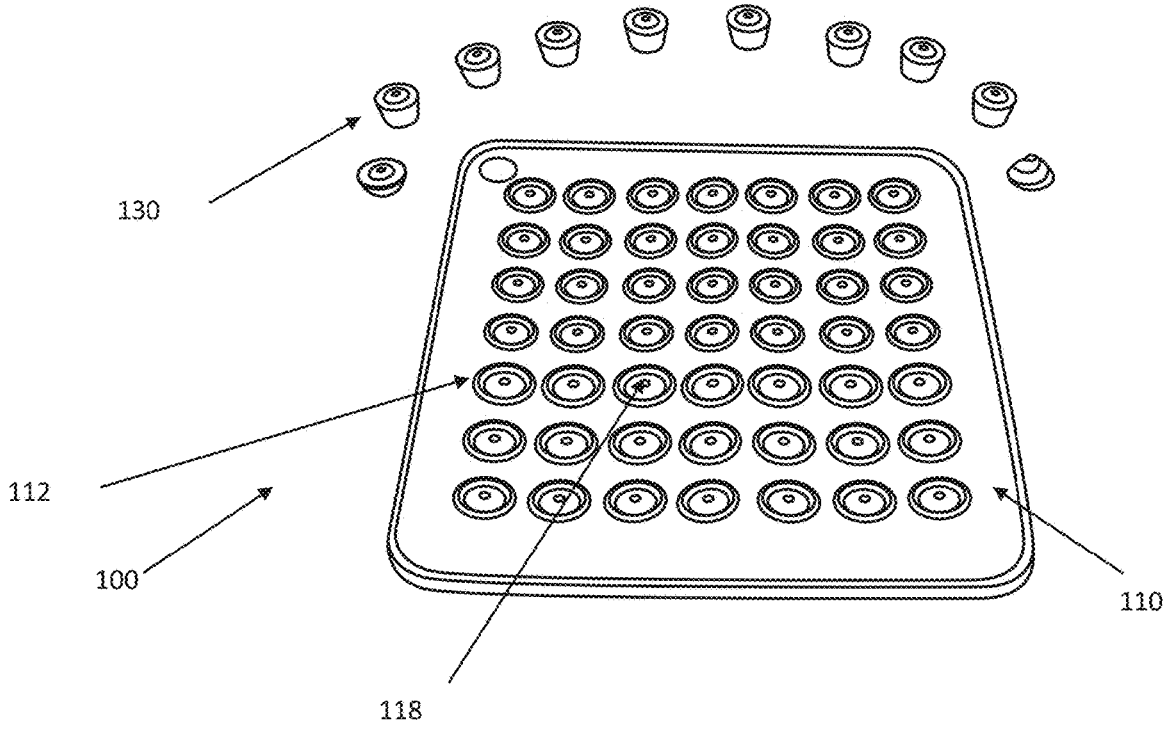
FIG. 1 discloses an embodiment of the present invention depicting the board with tokens placed around the board.
Figure 2:
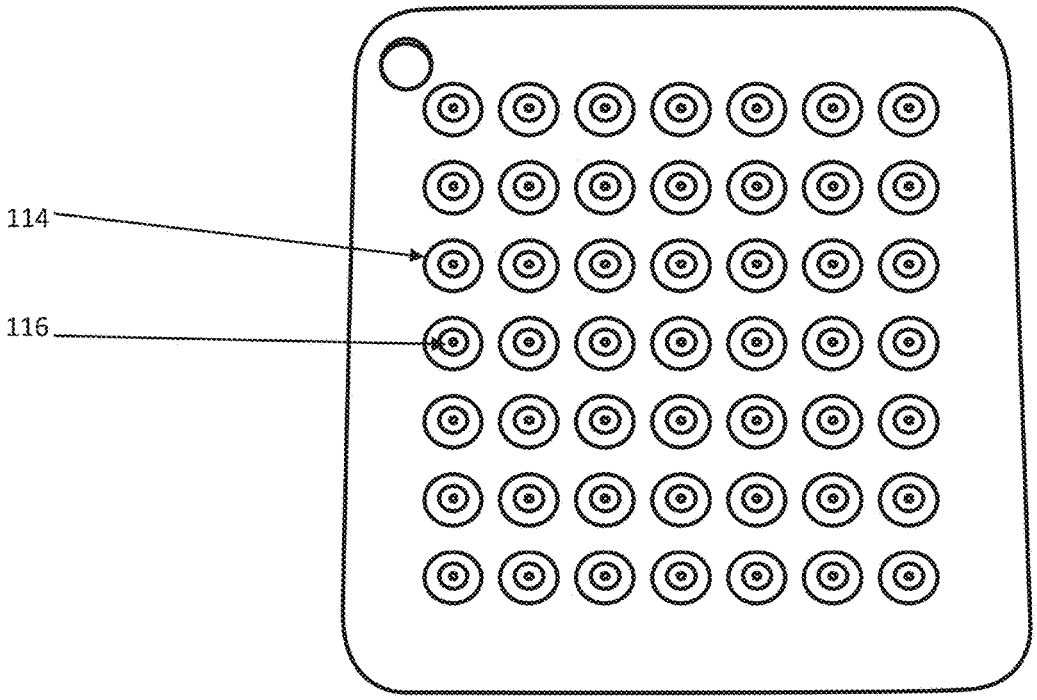
FIG. 2 discloses an embodiment of the present invention depicting the board with plurality of recess.
Figure 3:
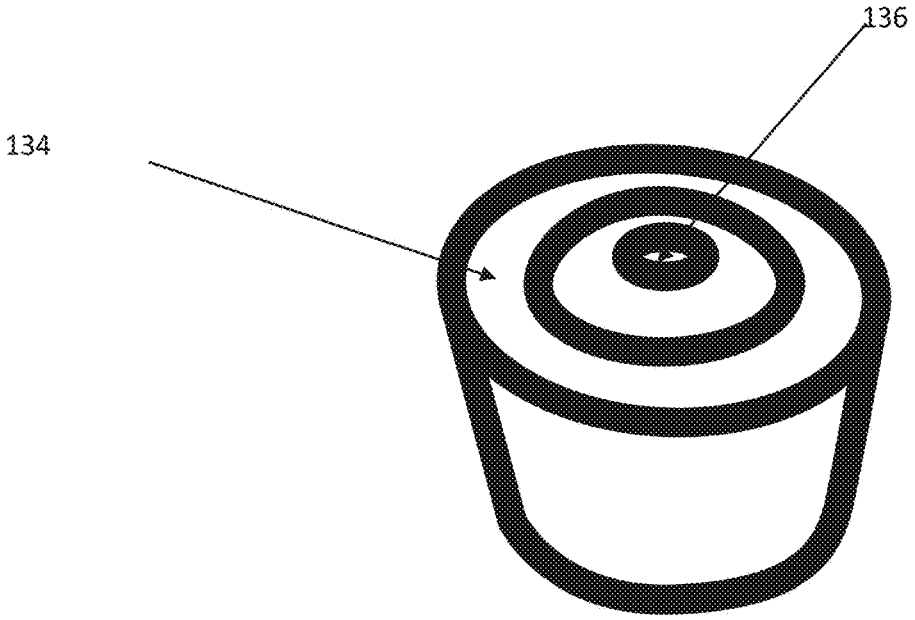
FIG. 3 discloses an embodiment of the present invention with the top view of the token.
Figure 4:
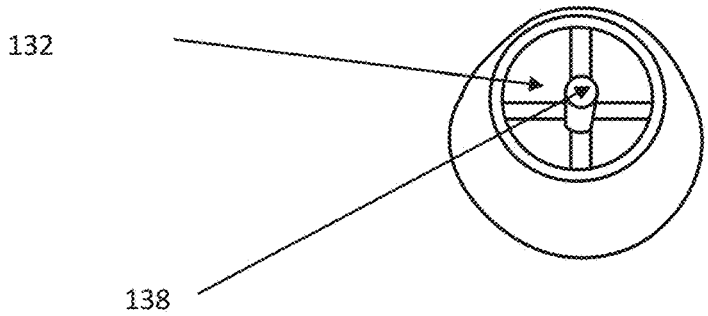
FIG. 4 discloses an embodiment of the present invention with the bottom view of the token.
Figure 5:
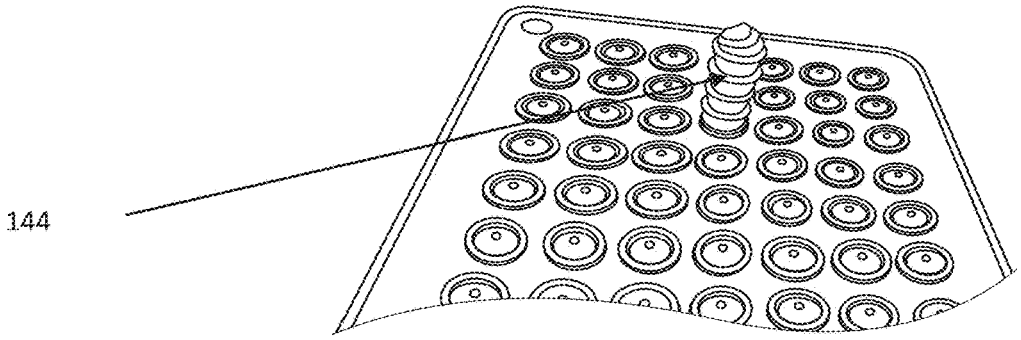
FIG. 5 discloses and embodiment of the present invention with tokens arranged in a stack.
Figure 6:
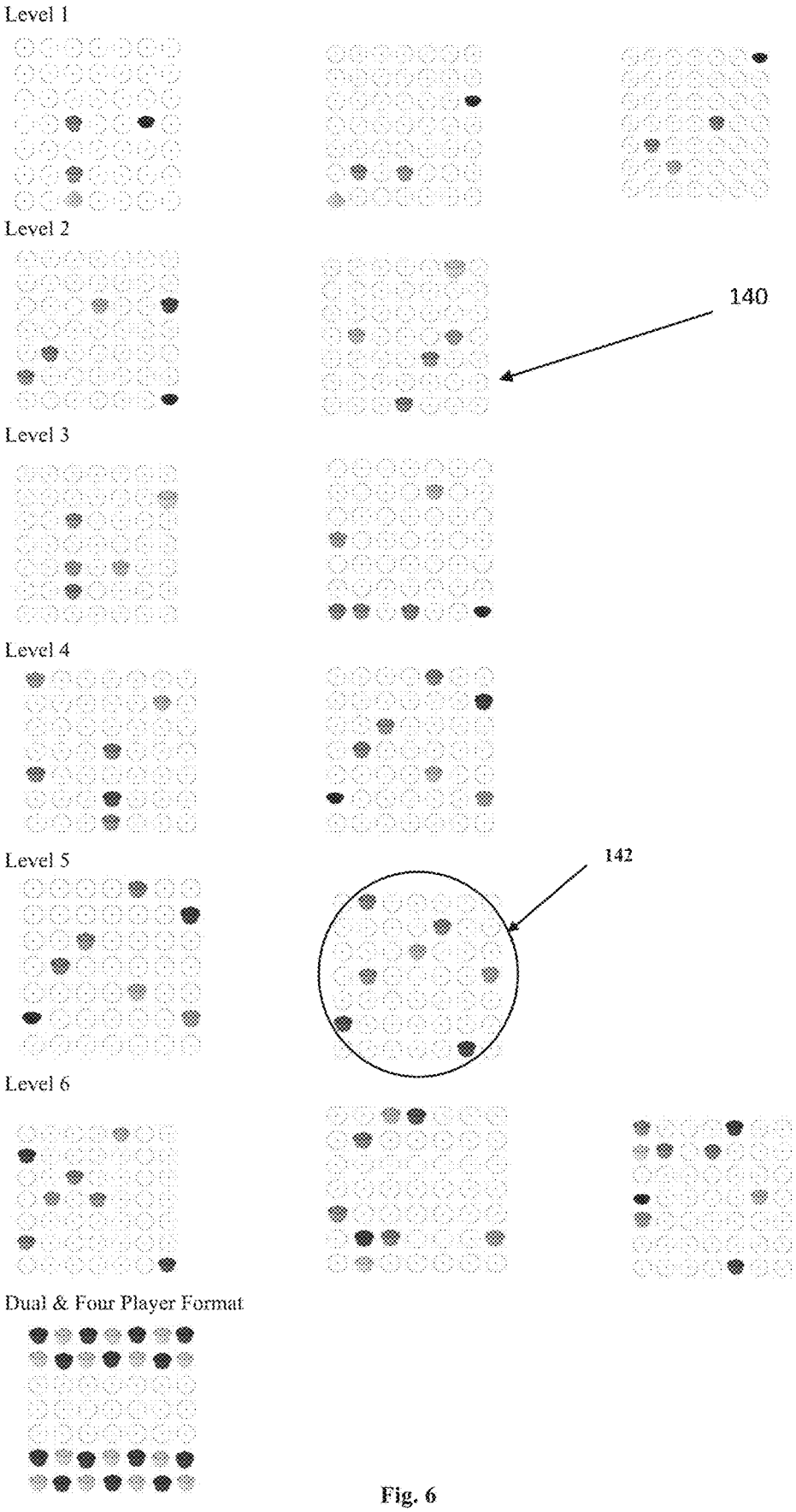
FIG. 6 discloses an embodiment of the present invention depicting cards with patterns.

| DESCRIPTION OF ELEMENTS | REFERENCE NUMERAL |
|---|---|
| Game board apparatus | 100 |
| Board | 110 |
| Recess | 112 |
| First Surface | 114 |
| Second Surface | 116 |
| Hole | 118 |
| Token | 130 |
| Hollow Open End | 132 |
| Closed Surface | 134 |
| Cavity | 136 |
| Projection | 138 |
| Card | 140 |
| Pattern | 142 |
| Stack | 144 |

DESCRIPTION OF SPECIFIC EMBODIMENTS OF THE INVENTION

The illustrated game board apparatus 100 comprises at least two tokens 130 with a hollow open end 132 and a closed surface 134.

The token 130 can be of any color and of any shape such as an icing, a muffin or a plate.

The closed surface 134 includes a cavity 136 which can be any shape such as cylindrical and a projection 138 extends from the closed surface 134 such that the projection 138 fits into the cavity 136 while staking one token 130 on top of another token 130.

A board 110 is provided with a plurality of recesses 112 structured on the board 110 to receive the tokens 130. The recess 112 formed on the board includes a first surface 114 which is protruding and a second surface 116 which is convex shaped such that the second surface is enclosed by the first surface 114. The second surface 116 has a hole 118 at the center of the second surface 116.

The closed surface 134 of the token 130 has a structure which is analogous to the structure of the recess 112 formed on the board. This analogy in the structure allows the stacking of one token 130 over another token 130.

In use, when the token 130 is placed over the board 110, the hole 118 formed in the second surface. The second surface 116 receives the hollow open end 132 of the token 130 thereby avoiding displacement of the token 130 from the surface of the board. While stacking, the cavity 136 in the closed surface 134 of the token 130 receives the projection 138 of the token 130.

In the present invention, at least one card 140 each consisting of different patterns 142 of tokens 130 is provided. There can be numerous such cards such that the complexity of the game progresses with subsequent card. The patterns 142 on these cards indicating a start mode for the game. A player is provided with the pattern 142 arranged on the board 110 and the player is required to form a stack starting from the provided pattern 142 wherein the icing/muffin shaped token represents the starting point and the plate/muffin shaped token represents the ending point.

The game board apparatus 100 is provided with:

- A white squared game board 110; surface with circular depressions and circular protrusions; each circular impression with a hole 118 in its center.
- 3D tokens 130 of different colors representing steps to be taken during sequencing given and thus called the step tokens, given in the form of muffin shapes to stack tokens on each other
- A start point token 130, given in the game in the form of an icing token, used per the need of situation design, to come at the top of the stack created by all the step (muffin) tokens used in the situation
- An end point token 130, given in the game in the form of a base plate, used per the need of situation design, to stack all the muffin tokens, to come at the bottom of the stack created by all the step (muffin) tokens used in the situation
- A step token 130 given in the form of muffin can also be used as start point and end point.
- A situations booklet with cards 140 arranged in a progressive level of complexity.
- A game playing manual.

This game can be used in 3 different formats of game playing—single player, dual player and four player format.

All the cards 140 used for playing single-player format in this game have only one unique answer i.e. game tokens 130 will always have one set of order in which they will appear in the stack 144 of tokens.

The representative set of cards given in this game for dual player and four player format in this game will have many possible answers thus creating engagement for competitive and/or collaborative learning experiences. These set of cards 140 are only directional set of cards 140 to explain the nature of neutral, equal opportunity pattern of tokens. The rules to create new situations in dual player and four player format has also been explained in the game manual enabling players to design new situations on their own.

In a single player game format the game is played by using a situation booklet consisting of cards 140. In a dual and four player game format, the game is played by creating various neutral, equal opportunity patterns of placement of tokens 130 on the game board 110 by mutually agreeing on the method of creation of such a pattern 142. In dual player, one player choses one type of colored tokens 130, all tokens of same color and the other player choses another type of colored tokens 130 i.e. all the tokens 130 of same color but different than the 1$^{st}$ player color and play the game turn-by-turn. In a four player format, each team comprises of 2 players choosing one type of colored tokens 130 and the other team choses other type of colored tokens 130, both the team members sit diagonally opposite to each other so that 2 players in the same team get the turn to take an action on the tokens of their color alternatively. All the four players agree to take a turn either in a clockwise or anticlockwise direction of rotation of turn.

The method to create a neutral, equal opportunity pattern has been explained in detail below.

In a single player format, the player is supposed to collect all the step tokens 130 given in the situation in the form of one single stack 144, as per the rules of movement of tokens 130 on the game board 110. In some situations, the start token 130 is given to define the start-point i.e. the point from where to start to collect all the tokens 130 or the token 130 which will always come on the top of the stack 144 created. In some situations, the start token 130 is not given for the player to define which step token should be the start point to achieve the objective of the game and situation. In some situations, the end point token 130 is given to define the end-point i.e. the point where all the tokens 130 are to be collected/stacked, and in some situations this token 130 is not given for the player to define which step token should be the end point to achieve the objective of the game and situation. In dual & four player format, both the start point and the end point tokens 130 are not given as the game in dual and four player format is required to be created as a dynamic game enabling desired/intended outcome continuing to change based upon the action taken by each player.

In a single player format, the cards 140 shall be treated to be solved successfully by verifying whether all the tokens 130 have been collected at one single point on the game by satisfying all the conditions of playing the game.

The game cards 140 have been organised in a progressive structure of thinking processes or methods of thinking This has been done to create each Stack the Muffins game/situation playing experience as a progressive learning system and tool where the players can bridge the gaps from the basics and go to further complex processes as per self-learning pace and his/her real-life application needs/scenarios. As the level of complexity increases from lower to higher order thinking in the cards 140 of the situation booklet, the type of mental skills required to place each token increases from simple to applying complex thinking skills in this Mental Planning Game set branded as Stack the Muffins.

Undergoing the lessons based on Stack the Muffins game enables learners to learn sequencing in forward and/or backwards direction i.e. from start point to the end point and/or from the end point to the start point, segmenting the situation in various shorter sequences and then combining each sequence to achieve the objective, identifying and evaluation various sequencing options and become equally flexible with both the types of sequencing i.e. forward and backward i.e. from start point to end point and from end point to start point.

In dual and four player formats, the core game mechanics remains the same as in single player format. Thus, dual player and four player format of game playing act as reinforcement of learning developed during single player game situation led playing. However, dual player and four player formats provide an excellent opportunity to each player to test their learnt thinking skills and processes in a competitive as well as a collaborative format triggering nurturing and development of various emotional and social skills. This extension of single player format game mechanics becoming input of game mechanics for dual player and four player format enables each player to dive deep into their executive functions and executive controls at the same time in both collaborative and competitive game playing formats. It also helps in developing respect and trust in self, team member's and opponent players' executive functions and executive controls and learn for it.

There are various terms imparted as a part of the game playing learning process which are described below for the learner to learn these terms as an experiential process of game playing. It experientially makes the learners practice various thinking skills in a progressive structure thus making the game playing experience a learning system of mental skills required as a part of mental planning based on how to analyse, evaluate and create desired outcome in each situation in the context of environment i.e. game board in which decision has to be made and thus where, how and following what steps to collect/stack 144 all the tokens given in the situation, as per game playing rules of this game.

Embodiments

The game board 110 design defines the length of sequencing steps, and thus types of skills based on these number of steps, and the squared shape of the game board is to provide neutrality to sequencing of steps, by using all the directions. The role of game tokens 130 is to properly fit on the game board 110 as well as get stacked on top of each other without falling.

If the game board 110 design is a 2×2 grid i.e. only 4 slots for tokens 140 to be placed on the game board, then the maximum length of sequencing will be only 1 step.

If 3×3 grid i.e. only 9 slots for tokens 130 to be placed on the game board 110, then the maximum length of sequencing will be only 2 steps.

If 4×4 grid i.e. only 16 slots for tokens 130 to be placed on the game board 110, then the maximum length of sequencing will be only 3 steps.

If 5×5 grid i.e. only 25 slots for tokens 130 to be placed on the game board 110, then the maximum length of sequencing will be only 4 steps.

If 6×6 grid i.e. only 36 slots for tokens 130 to be placed on the game board 110, then the maximum length of sequencing will be only 5 steps; and likewise.

To design this game board 110 based situations, 7×7 grid i.e. 49 slots for tokens 130 to be placed on the game board 110, have been used to create the maximum length of sequencing of 6 steps as learning.

In this game, one token 130 in the form of an identifiable shape as start point thus will always represent the starting point or the token 130 which will always come on the top of single stack 144, if given in the card 140 design. One token 130 in the form of an identifiable shape as end point thus will always represent the point where all the tokens 130 are required to be collected/stacked, if given in the card 140 design. Many different tokens 130 but of the same shape distinguished on the basis of color to represent as the step token i.e. the steps to be taken between the start point and end point as per the card/puzzle 140 design and thus to be collected at one single point (end point). The game cards/puzzles 140 have also been created without the use of start point token 130 and/or the end point token 130 where step tokens 130 given in the situation are to be used as start point and/or the end point token 130. This is to add to the learning progression i.e. how to identify the start point and/or the end point in the given situation while applying the rules of the game to sequence various steps using either forward and/or backward mental planning.

Based on the above principles, any dimension of the game board 110 and any form of game tokens 130 can be created.

Thus, the size of the game board 110; number of tokens 130 used in a given situation on the game board; positional placement of these tokens 130 on the game board in relationship to each other; whether start point and/or the end point token has been given or not; different levels of learning progression and complexity i.e. method used to identify from where to start and how to progress to the next subsequent steps to collect/stack all the tokens 130 at the identified end point, by following the rules of the game, can be created.

This game design thus uses size of game board 110, type of tokens 130 (i.e. all step tokens only; step tokens plus end point tokens 130 only; step tokens 130 plus start point token only; step tokens 130 plus end point token plus start point token) and number of tokens 130 used, and the relative placement of tokens 130 on the game board, all in conjunction create the learning progression and complexity in the card/puzzle design i.e. method used to collect/stack all the tokens 130, by following the rules of the game.

Method

First place all the game tokens 130 on the game board 110 by matching the pattern 142 of tokens 130 given in the puzzle/card 140 with the pattern 142 of the game board. Now, start from the given or identified start point token 130 and move in a step-by-step order while collecting step tokens 130 at each step, by making the step tokens 130 collected from previous step rest on the target step token of this step. Follow this process till all the step tokens given in the situation puzzle do not get stacked/collected at the given or identified end point. If the start point token is given in the card than that token 130 will always come on the top of the collected stack 144. If the end point token 130 is given in the situation than that token 130 will always come at the bottom of the collected stack 144. Thus, if the end token 130 is given in the situation than that token 130 cannot be moved to be placed on other tokens as in that case it will not come at the bottom of the stack 144 and thus will not qualify as the end point.

The stack 144 is to be formed by identifying the relationship between placement position of each token 130 with respect to all the other tokens 130.

There are cards 140 arranged in an age appropriate structure i.e. situations for age <5 years, 5-7 years, 7-9 years, 9-11 years, 11-13 years & >13 years. Each age band has various thinking processes in-built in it to create varied, progressive experiences for the player to test current thinking process and in-turn strengthen currently existing correct thinking processes and develop new thinking processes.

Though currently a player maybe of 12 years, it is recommended/desired for the player to play the situations from previous age bands first and then proceed to current age band situations. Such a structure of progressive situation arrangement, gives each player an opportunity to develop/bridge any missing thinking process as per the age and also develop thinking processes of higher age bands. To draw a parallel analogy here, an artificial intelligence to make the game playing process a personalised learning experience has been created through the arrangement of cards 140.

This makes the learner test existing method of thinking around mental planning and develop a new method of thinking, in a progressive learning structure created by changing the number of tokens 130, type of tokens 130 and relative positional placement of each token 130.

Thus, based on the number of tokens 130, type of tokens 130 and relative positional placement of each token 130, learning outcome and complexity at each level can be clearly defined and thus progression of learning outcome and complexity can be pre-defined. Thus, progression of learning outcome and learning complexity i.e. methods to do mental planning and sequencing using the game as an aid can be pre-defined.

Tokens Used in the Cards

- Step tokens 130 with start point token 130 and with end point token 130
- Step tokens 130 with start point token 130 and NO end point token 130
- Step tokens 130 with end point token 130 and NO start point token 130

Step tokens 130 with NO start point token 130 and NO end point token 130

Relevant Terms with Their Descriptive Meaning Based on this Game

Pattern=Representing arrangement of tokens on the game board

Environment=Place of action i.e. game board

Start point=Token which will always come on the top of the final, single stack achieved after collecting all the tokens to solve the card/puzzle End point=Token which will always come at the bottom of the final, single stack achieved after collecting all the tokens to solve the card/puzzle Possibility=Path in which a token or stack of tokens can move from one point to other point on the game board to solve the card/puzzle Shortest path=Least number of steps required to be taken by a token or stack of tokens to move from one point to other point on the game board to solve the card/puzzle Sequencing=Principle used to move a token or stack of tokens from one point to other point on the game board to solve the card/puzzle Sequencing Forward=Starting from the start point, identifying the shortest path to move to the next step and then to the next, to reach to the end point to solve the card/puzzle Sequencing Backwards=Starting from the end point, identifying the shortest path to move to the next step and then to the next, to reach to the start point and then taking action to execute the identified path/steps to solve the card/puzzle Segmenting=Breaking the forward sequencing and/or backwards sequencing in multiple stacks and then moving these stacks individually and/or collectively to solve the card/puzzle Executing=Taking physical action on the game board based on the mental planning i.e. forward and/or backward sequencing done in one single sequence or multiple sequences by segmenting to solve the card/puzzle Rules of Playing Stack the Muffins—Single Player Format:

Place all the game tokens 130 outside the game board 110, depending upon whether the player is left handed or right handed on the left or right side of the game board Place one token 130 at a time on the game board to replicate/copy the pattern given in the card/puzzle on the game board Token 130 once placed on the game board 110 should not be moved or replaced Rules of Movement Any token 130 or stack of tokens 130 while moving from one point to other point can move in any direction on the game board 110 i.e. horizontally, vertically, diagonally or their combinations.

Any token 130 or stack 144 of tokens will only move that many steps on the game board as many number of tokens 130 are there in the stack. Thus, a single token 130 stack 144 will only move one step on the game board 110, 2 tokens stack will only move 2 steps, and so on.

Any token 130 or stack of tokens can move only if lands on any other token i.e. it cannot move to an empty circle on the game board 110. Thus, token or stack of tokens will always move to land on another token or stack of tokens.

Any token 130 or stack of tokens while moving from one point to other point has to take a path which is vacant on the game board i.e. it cannot jump over another token.

Any token 130 or stack 144 of tokens will only move from one point to other point ONLY by following the shortest path i.e. the path which will require minimum number of steps to move from one point to other point. As there is no restriction in the movement direction i.e. horizontally, vertically, diagonally or their combinations, the rule to $1^{st}$ identify the shortest path by exploring all possible permutation and combinations of horizontal/vertical/diagonal movements, without jumping over any other token on the way, becomes extremely interesting and challenging. This flexibility created in this game, at times becomes very challenging for many players as it challenges the normal convention followed in many other games to restrict the directional movements of game tokens 130.

Open the card 140 to be solved, the card shall be treated to be solved successfully if all the tokens 130 have been collected/stacked at one point on the game board 110 by satisfying all the condition(s) stated above as the rules to play this game Stack the Muffins.

If any of the token(s) 130 has been moved on the game board 110 without satisfying all the conditions/rules of movement of this game, the situation is treated as unsolved and the player removes all the tokens 130 from the game board to place them outside the game board to attempt to solve the card 144 again from the start.

Rules of playing Stack the Muffins—Dual Player Format:

As the dual player format is evolution of single player format, without changing the game mechanics, thus the rule of movement of token(s) 130 shall remain the same in dual player format as were in single player format. This method of keeping the core game mechanics the same as it was in a single player format, is a unique learning progression design invented in this game, where thinking skills and processes learnt individually by each player now get tested in a dynamic environment of playing with/against each other.

The dual player game format is a competition between 2 players to collect more tokens 130 than the opposite player. Thus, in this structure, each player gets step tokens 130 of only a color, each. The dual player version can be played with as less tokens 130 as equal to the maximum number of sequencing steps possible as per the game board design. For example, in a 7×7 games board, maximum sequencing steps possible are 6, thus in a 7×7 game board, dual player version can be played with as less as 6 tokens 130 for each player of the same color and a maximum of 24 tokens 130 for each player i.e. by leaving the center most circle of the game board empty, balance 48 circles can be divided between 2 players i.e. 24 each and then players can decide to choose what neutral pattern they wish to create on the game board 110.

Both the players can mutually decide to play with as many tokens 130 they want from 6 and above number. They start the game by first creating a neutral, equal opportunity pattern for both the players. A neutral, equal opportunity pattern 142 will be a minor image of placement position of tokens 130 of one player versus other player tokens 130 around X and/or Y axis. One of the ways to do so is, each player places a token on the game board, from the agreed maximum number of tokens 130 that they wish to play the game with, and each player places a token 130 on the game board turn by turn. For example, player A choses the place to place the token 130 first and then player B copies the positional placement of the other player token by creating a minor image of the placed token on X and/or Y axis. Now, the player B choses the placement position and player A follows. Then the player A choses and player B follows. Thus, the final pattern 142 created will be a neutral, equal opportunity pattern for either player where both players having equal advantage to win the game. Thus, the winner will be the one who is able to better apply thinking skills learnt in single player format now in dual player format. While creating the neutral pattern in a 7×7 game board, the center circle will not be used by any player to place the token and the minor image placement of center circle will not be possible.

Core Rules of Game Play (Same as of Single Player Format)

- Any token 130 or stack of tokens while moving from one point to other point can move in any direction on the game board 110 i.e. horizontally, vertically, diagonally or their combinations.
- Any token or stack of tokens will only move that many steps on the game board as many number of tokens 130 are there in the stack 144. Thus, a single token stack will only move one step on the game board 110, 2 tokens stack will only move 2 steps, and so on.
- Any token 130 or stack of tokens can move only if lands on any other token i.e. it cannot move to an empty circle on the game board 110. Thus, token or stack 144 of tokens 130 will always move to land on another token or stack of tokens.
- Any token 130 or stack of tokens while moving from one point to other point has to take a path which is vacant on the game board 110 i.e. it cannot jump over another token.
- Any token 130 or stack of tokens will only move from one point to other point ONLY by following the shortest path i.e. the path which will require minimum number of steps to move from one point to other point. As there is no restriction in the movement direction i.e. horizontally, vertically, diagonally or their combinations, the rule to 1$^{st}$ identify the shortest path by exploring all possible permutation and combinations of horizontal/vertical/diagonal movements, without jumping over any other token on the way, becomes extremely interesting and challenging. This flexibility created in this game, at times becomes very challenging for many players as it challenges the normal convention followed in many other games to restrict the directional movements of game tokens 130.

Additional Rules of Game Play—Dual Player Format

- The player can ONLY move the token 130 or stack of tokens of his/her color. A stack of one's color is defined on the basis of the color of the top most token in that stack 144. Thus, a player can move his/her token 130 or stack of tokens on the token or stack of tokens of the other player's token or stack of tokens 130.
- It is a turn by turn game and each player has to make a move upon his/her turn. Thus, each player has to make a move till the time no legal move as per core rules of the game playing is possible.
- If a player has exhausted all legal moves possible, the other player continues to play the game till left with no legal move possible. In such a scenario, the player who has a legal move makes a move, then the other player checks whether any legal move has got created due to the move taken 130 by the other player, if yes, make a move or just says Tass/skip' for the other player to make a move.
- In case a player makes a move which is not permitted as per the core rules of the game, the other player can challenge the move. In such a scenario, the player who made an illegal move is at the mercy of the decision of the other player. The other player can chose any, but only one, of the following options. This situation only arises if the other player has spotted the illegal move at the time of movement itself before completion of this round and not during the later rounds. If the other player has not been able to spot the illegal movement before making his/her move, than the illegal move cannot be challenged later.
  - Pardon the other player's illegal move and allow the other player to change the move to a legal move.
  - Make the other player undo the illegal move and then can chose any of the following as a reward for self. The other player has to declare first which option he/she is choosing as a reward out of the following below. Only one option can be exercised at a time.
    - Withdraw any one token 130 of the opponent player from the game board and do any of the following. The token 130 can be withdrawn from a single token 130 stack or a multiple tokens stack but always has to be the top most token from that stack 144—
      - Add to any of his/her stack 144, at any position in the stack (to increase the number of tokens in his/her stack)
      - Add to other player's stack (to create a strategic advantage for self)
      - Place at any other position of his/her choice, anywhere on the game board 110.
    - Can take two consecutive moves on the game board i.e. other player who made a wrong move, has to skip a turn to move his/her tokens i.e. after making the other player undo the illegal move, take a turn and then make the other player skip his/her turn, and make another move.
- The game ends when both the players are left with no legal move to make on the game board 110.
- The winner is decided on the basis of which player has maximum number of tokens 130 in his/her stack, once both the players have exhausted their legal moves as per the core rules of the game play. The method of defining maximum numbers of tokens 130 in the stack can be chosen by players in many ways—
  - They could decide to call the tallest stack 144 on the game board the winning stack and thus the player whose token is at the top of this stack 144.
  - They could decide on the basis of sum total of all the stacks which belong to each player and then decide which one had the maximum number of tokens stacked.
  - They could also decide it on the basis how many tokens 130 of the other player's tokens they could acquire/collect in their stacks 144.
  - Etc., etc.

Additional Rules of Game Play—Four Player Format

- As the four player format is further evolution of dual player format, without changing the game mechanics of single player format, thus the rules of movement of token(s) 130 of single player and other rules used of dual player format will remain the same in four player format as well. This method of keeping the rules of single player core game mechanics and dual player competitive rules the same, is a unique learning progression design invented in this game, where thinking skills and processes learnt individually as well as in competitive format by each player now get tested and applied in a dynamic environment of playing in collaborative and competitive environment both, being created in four player format at the same time.

All the rules of single and dual player format apply in four player format.

The only difference from dual player in four player format is, in four player format there are 2 players competing with 2 players of the other team. So, each team is made of 2 players. The team members of each team sit diagonally opposite to each other i.e. the same color tokens will get to make a move on the game board 110 at alternative intervals. The game is played in clockwise or anticlockwise direction, turn-by-turn.

The players in the same team are collaborating with each other to win but are not allowed to talk or communicate in any form, verbal or non-verbal, with their respective team member. Thus, they now learn to apply skills learnt in a single & dual player format in a collaborative yet competitive environment, both.

The winner is decided as explained in dual player format.

Learning System Progression & Method of Deduction

Single Player Booklet progression based on design of 7×7 game board 6 progressive levels for Age 3-16 years Each level described below with an indicative situation from that level Level 1

Up to 3 steps sequencing, tokens 130 placement including given start token and given end point token with movement of tokens possible only in horizontal and/or vertical directions; all tokens can be collected through single, direct forward or backward sequencing.

Up to 3 steps sequencing, tokens 130 placement including given start token and given end point token with movement of tokens possible in horizontal and/or vertical and/or diagonal directions; all tokens can be collected through single, direct forward or backward sequencing.

Up to 3 steps sequencing, tokens 130 placement including given end point token (NO start token given) with movement of tokens possible in horizontal and/or vertical and/or diagonal directions; all tokens can be collected through single, direct forward or backward sequencing.

Level 2

Up to 4 steps sequencing, tokens 130 placement including given end point token with movement of tokens possible in horizontal and/or vertical and/or diagonal directions; all tokens can be collected through single, direct forward or backward sequencing.

Up to 4 steps sequencing, tokens 130 placement without given end point token with movement of tokens possible in horizontal and/or vertical and/or diagonal directions; all tokens can be collected through single, direct forward or backward sequencing.

Level 3

Up to 5 steps sequencing, tokens 130 placement without given end point token with movement of tokens possible in horizontal and/or vertical and/or diagonal directions; any one step during the sequencing having 2 options as next step; all tokens can be collected through single, direct forward or backward sequencing.

Up to 5 steps sequencing, tokens 130 placement including given end point token with movement of tokens possible in horizontal and/or vertical and/or diagonal directions; any one step during the sequencing having 2 options as next step; all tokens can be collected through single, direct forward or backward sequencing.

Level 4

Up to 6 steps sequencing, tokens 130 placement without given end point token with movement of tokens possible in horizontal and/or vertical and/or diagonal directions; step(s) during the whole sequencing having 2/3 options as next step; all tokens can be collected through single, direct forward or backward sequencing.

Up to 6 steps sequencing, tokens placement including given end point token with movement of tokens possible in horizontal and/or vertical and/or diagonal directions; step(s) during the whole sequencing having 2/3 options as next steps; all tokens can be collected through single, direct forward or backward sequencing.

Level 5

Up to 6 steps sequencing, tokens placement without given end point token with movement of tokens possible in horizontal and/or vertical and/or diagonal directions; multiple steps during the whole sequencing having 2/3 options as next steps; all tokens can be collected through single, direct forward or backward sequencing.

Level 6

Up to 6 steps sequencing, tokens 130 placement without given end point token with movement of tokens possible in horizontal and/or vertical and/or diagonal directions; steps (s) during the whole sequencing having 2/3/4 options as next steps; all tokens can be collected through single, direct forward or backward sequencing.

Up to 6 steps sequencing in each segment, tokens 130 placement with/without given end point token with movement of tokens possible in horizontal and/or vertical and/or diagonal directions; token placement in such a way that all the tokens cannot be collected through single, direct forward or backward sequencing at the end point token i.e. only segments of sequences can be collected at the end point token; placement of tokens requiring to create only 2/3/4 segments of sequences with segments moving directly at the end point or on each other; each segment sequencing requiring learning from previous levels.

Dual & Four Player Format 14 tokens 130 placement situation for each player i.e. 28 total tokens on the game board, each situation based on principles of creation of neutral, equal opportunity patterns; summarising learning and application of all the thinking skills and processes learnt from single player format booklet; further advancing the complexity of single player format situations by adding more number of tokens and making it a competitive and/or collaborative game structure.

What is claimed is:

1. A method of facilitating the play of a board game comprising:

providing a board having a surface with a plurality of recesses each positioned in another one of a plurality of intersections of a plurality of columns and a plurality of rows;

providing a plurality of tokens, each of the plurality of tokens is shaped in one of a first shape, a second shape and a third shape, said first shape, said second shape and said third shape are three different shapes, wherein said first shape is adapted to be placed by fitting in any of said plurality of recesses, and is adapted to accept stacking only of said second shaped token, when placed on top of said first shaped token, wherein said second shape is adapted to be stacked on top of any of said first shape token and of another token of said second shape and is further adapted to accept stacking of any of said second shaped token and said third shaped token when placed on top of said second shaped token, wherein said third shape is adapted to be stacked only on top of said second shaped token and is shaped not to accept stacking of any of said first shape token and said second shape token on top of said third shape token, and wherein each of said plurality of recesses is shaped in accordance with said first shape to allow fitted placement of said first shape in each of said plurality of recesses and avoiding unintentional displacement of a placed token from a respective recess, providing a plurality of cards each depicting a pattern of placement of tokens on said board; and providing a game playing manual comprising instructions for playing using said board, said plurality of cards and said plurality of tokens, said instructions comprising instructions for:

arranging on said board at least two tokens of the plurality of tokens, by placing into a selected one of said plurality of recesses, in a pattern depicted in a card selected from said plurality of cards, forming a stack by placing a token of said plurality of tokens over another token of said plurality of tokens which is shaped to accept stacking on top, wherein said forming said stack is done by selecting a shortest path, defined by neighboring recesses on said board, such that a number of steps taken for forming said stack is equal to a number of tokens included in the stack.

2. The method of facilitating the play of a board game, of claim 1, wherein said instructions comprising instructions for placing a token only over another token.

3. The method of facilitating the play of a board game, of claim 1, wherein said instructions comprising instructions for a player to progresses to a next level of complexity based on a pattern depicted on a subsequent card of a played card, once a stack is formed at one single point.

4. The method of facilitating the play of a board game, of claim 1, wherein said instructions comprising instructions for defining a starting point for stacking as indicated by any one of said third shaped token and said second shaped token, and defining an ending point as indicated by any one of said first shaped token and said second shaped token.

5. The method of facilitating the play of a board game, of claim 1, wherein said instructions comprising instructions for stacking, by displacing the tokens on said board in any one of a vertical direction, a horizontal direction, a diagonal direction and any combination thereof.

6. The method of facilitating the play of a board game, of claim 1, wherein said instructions comprising instructions for playing said game by at least one player.

7. The method of facilitating the play of a board game, of claim 1, wherein said instructions comprising instructions for a player to collect all tokens included in a stack, when said player has succeeded in arranging said stack.

8. The method of facilitating the play of a board game, of claim 1, wherein said board game is digital.

9. The method of facilitating the play of a board game, of claim 1, wherein said board is square shaped.

10. The method of facilitating the play of a board game, of claim 1, wherein each of said plurality of recesses is circular.

* * * * *